US010052528B2

(12) United States Patent
Johnson

(10) Patent No.: US 10,052,528 B2
(45) Date of Patent: Aug. 21, 2018

(54) SPORT TRAINING BALL

(71) Applicant: MarShaan C. Johnson, Minneapolis, MN (US)

(72) Inventor: MarShaan C. Johnson, Minneapolis, MN (US)

(73) Assignee: MarShaan C. Johnson, Minneapolis, MN (US)

( * ) Notice: Subject to any disclaimer, the term of this patent is extended or adjusted under 35 U.S.C. 154(b) by 0 days.

(21) Appl. No.: 14/818,919

(22) Filed: Aug. 5, 2015

(65) Prior Publication Data

US 2016/0008672 A1 Jan. 14, 2016

Related U.S. Application Data

(63) Continuation-in-part of application No. 13/744,286, filed on Jan. 17, 2013, now abandoned.

(60) Provisional application No. 61/631,942, filed on Jan. 17, 2012.

(51) Int. Cl.

| | |
|---|---|
| ***A63B 41/00*** | (2006.01) |
| ***A63B 21/06*** | (2006.01) |
| ***A63G 31/00*** | (2006.01) |
| ***A63B 43/00*** | (2006.01) |
| *A63B 69/00* | (2006.01) |

(52) U.S. Cl.

CPC ..... *A63B 41/00* (2013.01); *A63B 21/0606* (2013.01); *A63B 43/00* (2013.01); *A63B 69/0071* (2013.01); *A63G 31/007* (2013.01); *A63B 21/0602* (2013.01); *A63B 69/002* (2013.01); *A63B 2208/03* (2013.01); *A63B 2225/60* (2013.01); *A63B 2225/605* (2013.01)

(58) Field of Classification Search

CPC ..... A63B 41/02; A63B 43/04; A63B 43/00; A63B 2041/00; A63B 2043/00; A63B 2225/60; A63B 2225/605; A63B 41/00; A63B 21/0606; A63B 69/0071; A63B 21/0602; A63B 2208/03; A63B 69/002; A63G 31/007

USPC ..... 473/603–605, 594, 595, 609

See application file for complete search history.

(56) References Cited

U.S. PATENT DOCUMENTS

| | | | | |
|---|---|---|---|---|
| 2,540,403 A * | 2/1951 | Myers | A63H 27/10 | 446/221 |
| 2,625,770 A * | 1/1953 | Steen | A63H 27/10 | 446/221 |
| 3,655,197 A * | 4/1972 | Milbaum | A63F 5/04 | 273/146 |
| 4,915,669 A * | 4/1990 | Russell | A63B 43/04 | 446/221 |
| 4,917,381 A * | 4/1990 | Spector | A63B 41/02 | 273/DIG. 14 |

(Continued)

*Primary Examiner* — Steven Wong

(74) *Attorney, Agent, or Firm* — Michael T. Abramson; Holland & Knight LLP

(57) ABSTRACT

A sport training ball for use underwater includes a resilient spherical body. An internal chamber may be positioned within the resilient spherical body and configured to receive a low-density medium having a density less than water. A second internal chamber may be positioned within the resilient spherical body and configured to receive the low-density medium. A buoyancy reduction device may be positioned within the resilient spherical body and configured to have a density greater than or equal to water.

20 Claims, 3 Drawing Sheets

(56) References Cited

U.S. PATENT DOCUMENTS

| | | | | | |
|---|---|---|---|---|---|
| 5,054,778 | A * | 10/1991 | Maleyko | A63B 43/06 | 273/DIG. 8 |
| 5,070,610 | A * | 12/1991 | Leslie | A63B 43/04 | 29/899.1 |
| 5,098,329 | A * | 3/1992 | Tseng | A63H 27/10 | 446/221 |
| 5,462,273 | A * | 10/1995 | Spector | A63B 41/02 | 273/DIG. 20 |
| 5,499,822 | A * | 3/1996 | Sabourin | A63B 67/007 | 273/348 |
| 5,891,000 | A * | 4/1999 | Phillips | A63B 21/00189 | 473/594 |
| 7,264,533 | B2 * | 9/2007 | Chan | A63H 3/06 | 446/183 |
| 7,559,862 | B2 * | 7/2009 | Von Heland | A63B 37/00 | 473/352 |
| 8,342,991 | B2 * | 1/2013 | Spector | A63B 41/00 | 473/576 |
| 2002/0077201 | A1 * | 6/2002 | Davies | A63B 41/02 | 473/604 |
| 2010/0184541 | A1 * | 7/2010 | Kessler | A63B 37/08 | 473/570 |
| 2011/0003655 | A1 * | 1/2011 | Chernick | A63B 39/00 | 473/594 |
| 2011/0183791 | A1 * | 7/2011 | Lo | A63B 41/02 | 473/605 |

* cited by examiner

SPORT TRAINING BALL

RELATED CASE

This application is a continuation-in-part of U.S. patent application Ser. No. 13/744,286 filed on 17 Jan. 2013 by MarShaan Connell Johnson, entitled "Sport Training Ball", which claims the benefit of U.S. Provisional Application No. 61/631,942, filed on 17 Jan. 2012, by MarShaan Connell Johnson, entitled "Pool Training Basketball", the contents of which are incorporated herein by reference.

TECHNICAL FIELD

This disclosure relates to balls and, more particularly, to underwater balls used for training purposes.

BACKGROUND

As with any other professional, athletes often employ rigorous training procedures in order to stay in shape and maintain top performance. Often times, training may occur inside of swimming pools, as the resistance provided by the water enhances the level of exercise experienced by the athlete. For example, basketball players often train within swimming pools, where they may practice their moves within a swimming pool so that the drag created by the water provides a higher level of workout to their muscles. Additionally, such procedures may be used for rehabilitative therapy for basketball players.

Often times, athletes employ various objects during their training For example, basketball players train with basketballs. Unfortunately, the use of a basketball is not conducive to training within a swimming pool, as the buoyancy of the basketball prohibits e.g., the dribbling of the same underwater.

BRIEF SUMMARY OF DISCLOSURE

In one implementation, a sport training ball for use underwater may include but is not limited to a resilient spherical body. An internal chamber may be positioned within the resilient spherical body and configured to receive a low-density medium having a density less than water. A second internal chamber may be positioned within the resilient spherical body and configured to receive the low-density medium. A buoyancy reduction device may be positioned within the resilient spherical body and configured to have a density greater than or equal to water.

One or more of the following features may be included. The quantity of the low density medium may be adjustable to control the overall buoyancy of the sport training ball. The low density medium may be air. The buoyancy reduction device may be constructed of a high-density material having a density at least equal to water. The high-density material may be rubber. The buoyancy reduction device may be configured to receive a high-density material having a density at least equal to water. The quantity of the high-density material may be adjustable to control the overall buoyancy of the sport training ball. The high-density material may be water. The resilient spherical body may be constructed, at least in part, of rubber. The resilient spherical body may be constructed, at least in part, of leather. The sport training ball may be a basketball.

In another implementation, a sport training basketball for use underwater may include but is not limited to a resilient spherical body. An internal chamber may be positioned within the resilient spherical body and configured to receive a low-density medium having a density less than water. A second internal chamber may be positioned within the resilient spherical body and configured to receive the low-density medium. A buoyancy reduction device may be positioned within the resilient spherical body and configured to have a density greater than or equal to water. The buoyancy reduction device may be constructed of a high-density material having a density at least equal to water.

One or more of the following features may be included. The quantity of the low density medium may be adjustable to control the overall buoyancy of the sport training ball. The low density medium may be air. The high-density material may be rubber. The resilient spherical body may be constructed, at least in part, of rubber. The resilient spherical body may be constructed, at least in part, of leather.

In another implementation, a sport training basketball for use underwater may include but is not limited to a resilient spherical body constructed, at least in part, of rubber. An internal chamber may be positioned within the resilient spherical body and configured to receive a low-density medium having a density less than water. A second internal chamber may be positioned within the resilient spherical body and configured to receive the low-density medium. A buoyancy reduction device may be positioned within the resilient spherical body and configured to have a density greater than or equal to water. The buoyancy reduction device may be constructed of a high-density material having a density at least equal to water. The low density medium may be air.

One or more of the following features may be included. The quantity of the low density medium may be adjustable to control the overall buoyancy of the sport training ball. The high-density material may be rubber.

The details of one or more implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

Figure 1:
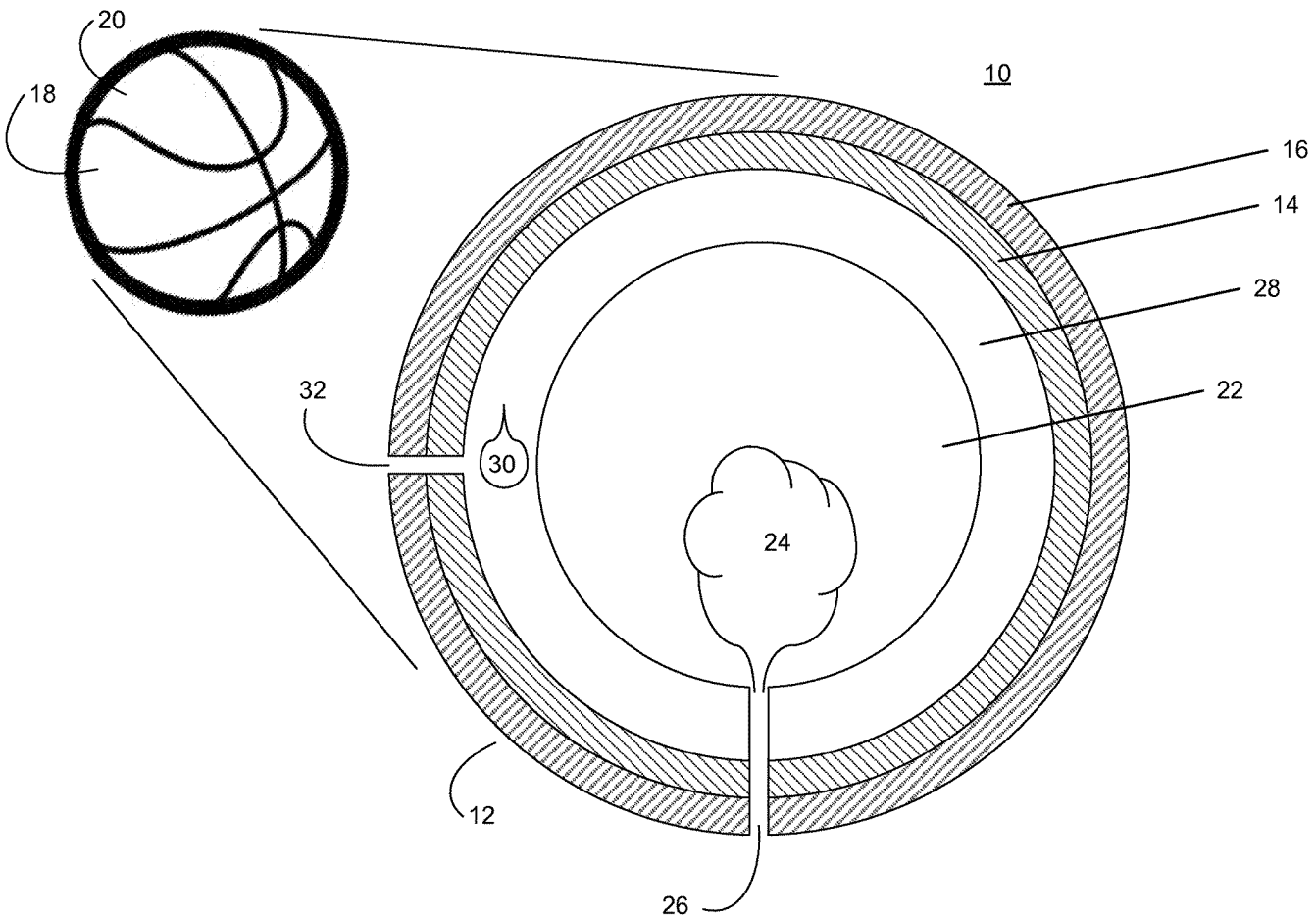
FIG. 1 is a diagrammatic view of a sport training ball according to one or more example implementations of the disclosure.

Referring to FIG. 1, there is shown sport training ball 10 for underwater usage. As will be discussed below, sport training ball 10 may be configured to have a reduced buoyancy so that it may be used (e.g., dribbled) underwater. An example of sport training ball 10 may include, but is not limited to, a basketball. Other examples may include but are not limited to pool toys and soccer balls.

Sport training ball 10 may include resilient spherical body 12. Resilient spherical body 12 may be constructed of various components, such as rubber and/or leather. For example, resilient spherical body 12 may include rubber layer 14, which may be covered by leather layer 16. For example, rubber layer 14 may be a molded rubber sphere, wherein leather layer 16 may be a multi-panel layer (e.g., including panels 18, 20), wherein e.g., panels 18, 20 are sewn together to form a spherical leather shell (e.g., leather layer 16). Alternatively, layers 14, 16 may both be constructed of rubber.

Sport training ball 10 may include internal chamber 22, which may be positioned within resilient spherical body 12 and may be configured to receive a low-density medium (e.g., low density medium 24) having a density less than water (e.g., less than 1,000 kilograms/cubic meter). An example of low density medium 24 may include, but is not limited to, air. The quantity of low density medium 24 may be adjustable to control the overall buoyancy of sport training ball 10. For example, sport training ball 10 may include passage 26 through which low density medium 24 may be added to fill/ pressurize internal chamber 22. Accordingly, a bicycle pump (not shown) with a filler pin (not shown) may be used to add air to internal chamber 22.

Sport training ball 10 may also include buoyancy reduction device 28, which may be positioned within resilient spherical body 12 and may be configured to have a density greater than or equal to water (e.g., greater than or equal to 1,000 kilograms/cubic meter). Buoyancy reduction device 28 may be constructed of a high-density material having a density at least equal to water (e.g., rubber). Accordingly, the quantity of rubber used to construct buoyancy reduction device 28 may be varied to adjust the buoyancy of sport training ball 10. Specifically, the spherical thickness of buoyancy reduction device 28 may be increased or decreased to adjust the mass (and therefore the buoyancy) of sport training ball 10.

Additionally/alternatively, buoyancy reduction device 28 may be configured to receive a high-density material (e.g., high-density material 30) having a density at least equal to water. For example, buoyancy reduction device 28 may include a layer forming a chamber for receiving high-density material 30. An example of hi-density material 30 may include, but is not limited to, water. The quantity of high-density material 30 included within buoyancy reduction device 28 may be adjustable to control the overall buoyancy of sport training ball 10. For example, sport training ball 10 may include passage 32 through which high-density material 30 may be added to fill/pressurize buoyancy reduction device 28. Accordingly, a bicycle pump (not shown) with a filler pin (not shown) may be used to add water to buoyancy reduction device 28.

In some implementations, buoyancy reduction device 28 may include a plurality of layers, which may be positioned within resilient spherical body 12 and may be configured to have a density less than or equal to air, similarly to low density medium 24. For instance, in addition to the layer forming the first internal chamber 22 of buoyancy reduction device 28, buoyancy reduction device 28 may further include a second layer to form internal chamber 34, which may be inside internal chamber 22. It will be appreciated that internal chamber 34 need not be inside internal chamber 22, and may be anywhere within resilient spherical body 12. Internal chamber 34 may be constructed similarly as is internal chamber 22. The quantity of the material used to construct the internal chamber 34 may be varied to adjust the buoyancy of sport training ball 10. Specifically, the spherical thickness of the second layer forming internal chamber 34 of buoyancy reduction device 28 may be increased or decreased to adjust the mass (and therefore the buoyancy) of sport training ball 10.

Additionally/alternatively, internal chamber 34 may be configured to receive a low-density material (e.g., low-density material 24) having a density at least equal to water. For example, buoyancy reduction device 28 may include internal chamber 34 for receiving low-density material 24. The quantity of low-density material 24 included within internal chamber 34 may be adjustable to control the overall buoyancy of sport training ball 10. For example, sport training ball 10 may include passage 36 through which low-density material 24 may be added to fill/pressurize internal chamber 34 of buoyancy reduction device 28. Accordingly, a bicycle pump (not shown) with a filler pin (not shown) may be used to add low-density material 24 to internal chamber 34 of buoyancy reduction device 28.

In some implementations, internal chamber 34 may create an evenly distributed pressure on chamber 22, thereby causing its contents to be at a restricted state, such that that when sport training ball 10 is underwater, it has a predictable return to the user after being dribbled (underwater). Thus, the combination of having three levels of various densities enables the user to dribble sport training ball 10 underwater. In some implementations, internal chamber 34 may help the user empty chamber 22.

Figure 2:
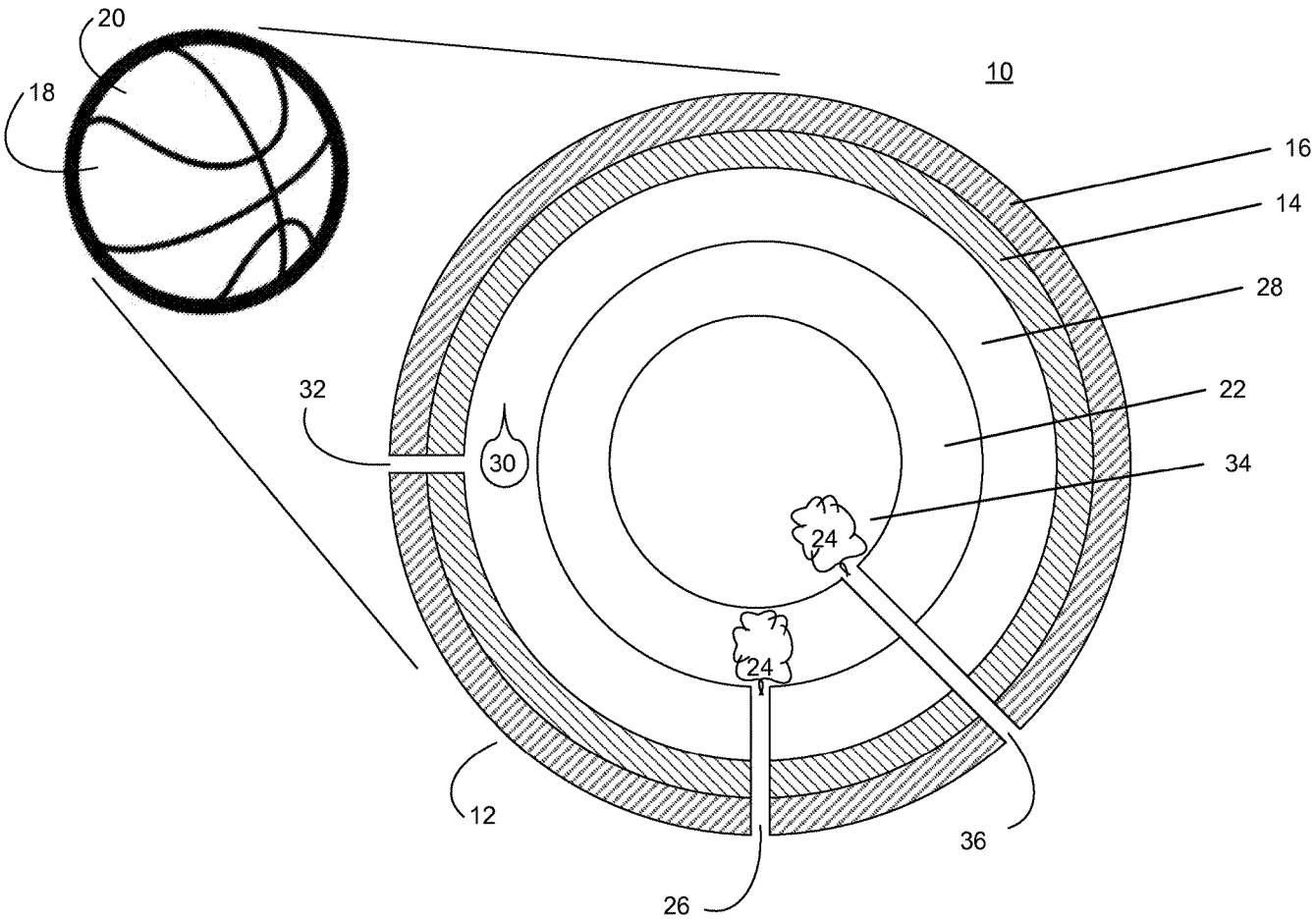
FIG. 2 is a diagrammatic view of a sport training ball according to one or more example implementations of the disclosure.
Figure 3:
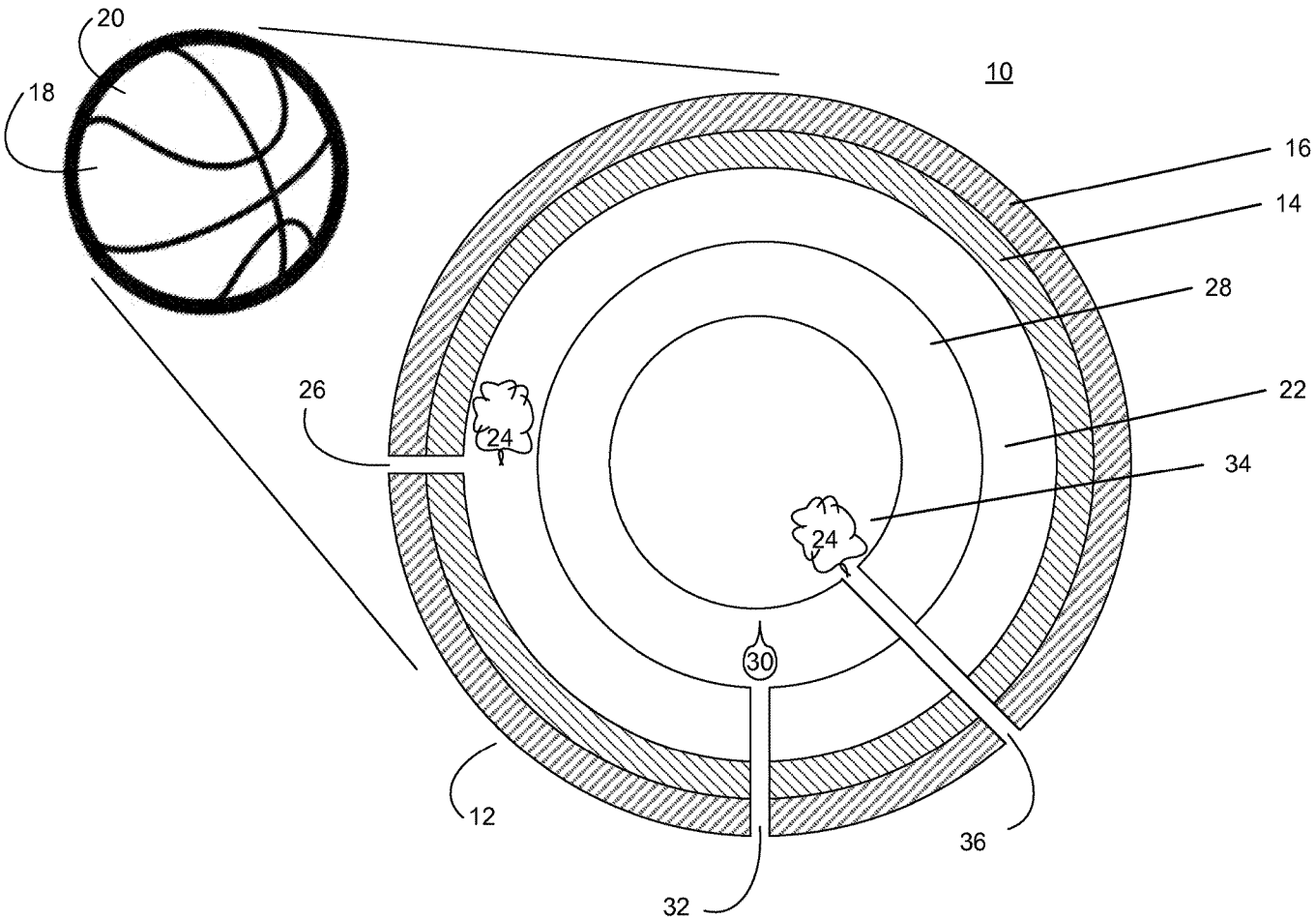
FIG. 3 is a diagrammatic view of a sport training ball according to one or more example implementations of the disclosure.

It will be appreciated that various layers may be used without departing from the scope of the disclosure. For example, while two to three layers and two internal chambers are disclosed, more or less layers and more or less internal chambers may be used. Additionally, the order of layers/chambers may be varied without departing from the scope of the disclosure. For example, while FIGS. 1-2 show high-density material 30 as the outermost layer, followed by low-density medium 24 in chambers 22 and 34, respectively, low-density medium 24 in chambers 22 and 34 may be the outermost layers, followed by high-density material 30 as the innermost layer. As another example, and referring at least to FIG. 3, low-density medium 24 in chamber 22 may be the outermost layer, high-density material 30 may be the middle layer, and low-density medium 34 in chamber 34 may be the innermost layer. As another example, at least one of chamber 22 and chamber 34 may be configured to receive high-density material 30, thereby having either chamber receive high-density material 30, low-density medium 24, or combination thereof As such, any ordered combination of high-density material 30 and/or low-density medium 24 may be used without departing from the scope of the disclosure, and thus the description of specific combinations and order of high-density material 30 and/or low-density medium 24 in the present disclosure should be taken as example only.

The terminology used herein is for the purpose of describing particular implementations only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents of all means or step plus function elements that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to best explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. A sport training ball for use underwater comprising:

a resilient spherical body;

an internal chamber positioned within the resilient spherical body with a low-density medium having a density less than water;

a second internal chamber positioned within the resilient spherical body with the low-density medium; and a buoyancy reduction device positioned within the resilient spherical body with a liquid high-density medium at least equal to water, wherein each of the internal chamber, the second internal chamber, and the buoyancy reduction device are spherical in shape.

2. The sport training ball of claim 1 wherein the quantity of the low density medium is adjustable to control the overall buoyancy of the sport training ball.

3. The sport training ball of claim 2 wherein the low density medium is air.

4. The sport training ball of claim 1 wherein the buoyancy reduction device is constructed of a high-density material having a density at least equal to water.

5. The sport training ball of claim 4 wherein the high-density material is rubber.

6. The sport training ball of claim 4 wherein the buoyancy reduction device is configured to receive a high-density material having a density at least equal to water.

7. The sport training ball of claim 6 wherein the quantity of the high-density material is adjustable to control the overall buoyancy of the sport training ball.

8. The sport training ball of claim 6 wherein the high-density material is water.

9. The sport training ball of claim 1 wherein the resilient spherical body is constructed, at least in part, of rubber.

10. The sport training ball of claim 1 wherein the resilient spherical body is constructed, at least in part, of leather.

11. The sport training ball of claim 1 wherein the sport training ball is a basketball.

12. A sport training basketball for use underwater comprising:

a resilient spherical body;

an internal chamber positioned within the resilient spherical body with a low-density medium having a density less than water;

a second internal chamber positioned within the resilient spherical body with the low-density medium; and a buoyancy reduction device positioned within the resilient spherical body with a liquid high-density medium at least equal to water;

wherein the buoyancy reduction device is constructed of a high-density material having a density at least equal to water, and wherein each of the internal chamber, the second internal chamber, and the buoyancy reduction device are spherical in shape.

13. The sport training ball of claim 12 wherein the quantity of the low density medium is adjustable to control the overall buoyancy of the sport training ball.

14. The sport training ball of claim 13 wherein the low density medium is air.

15. The sport training ball of claim 12 wherein the high-density material is rubber.

16. The sport training ball of claim 12 wherein the resilient spherical body is constructed, at least in part, of rubber.

17. The sport training ball of claim 12 wherein the resilient spherical body is constructed, at least in part, of leather.

18. A sport training basketball for use underwater comprising:

a resilient spherical body constructed, at least in part, of rubber;

an internal chamber positioned within the resilient spherical body with a low-density medium having a density less than water;

a second internal chamber positioned within the resilient spherical body with the low-density medium; and a buoyancy reduction device positioned within the resilient spherical body with a liquid high-density medium at least equal to water, wherein the buoyancy reduction device is constructed of a high-density material having a density at least equal to water, and wherein each of the internal chamber, the second internal chamber, and the buoyancy reduction device are spherical in shape;

wherein the low density medium is air.

19. The sport training ball of claim 18 wherein the quantity of the low density medium is adjustable to control the overall buoyancy of the sport training ball.

20. The sport training ball of claim 18 wherein the high-density material is rubber.

* * * * *